US010156165B2

(12) United States Patent
Scheidig et al.

(10) Patent No.: US 10,156,165 B2
(45) Date of Patent: Dec. 18, 2018

(54) MULTI-LOCKING OF A CAMSHAFT ADJUSTER, AND METHOD FOR OPERATING A CAMSHAFT ADJUSTER

(71) Applicant: Schaeffler Technologies AG & Co. KG, Herzogenaurach (DE)

(72) Inventors: Gerhard Scheidig, Oberasbach (DE); Michael Busse, Herzogenaurach (DE)

(73) Assignee: Schaeffler Technologies AG & Co., KG, Herzogenaurach (DE)

( * ) Notice: Subject to any disclaimer, the term of this patent is extended or adjusted under 35 U.S.C. 154(b) by 0 days.

(21) Appl. No.: 15/023,659

(22) PCT Filed: Jul. 25, 2014

(86) PCT No.: PCT/DE2014/200353
§ 371 (c)(1),
(2) Date: Mar. 21, 2016

(87) PCT Pub. No.: WO2015/039657
PCT Pub. Date: Mar. 26, 2015

(65) Prior Publication Data

US 2016/0230614 A1 Aug. 11, 2016

(30) Foreign Application Priority Data

Sep. 23, 2013 (DE) ..... 10 2013 219 075

(51) Int. Cl.
*F01L 13/00* (2006.01)
*F01L 1/344* (2006.01)

(52) U.S. Cl.
CPC ... *F01L 1/3442* (2013.01); *F01L 2001/34423* (2013.01); *F01L 2001/34453* (2013.01);
(Continued)

(58) Field of Classification Search
CPC ..... F01L 1/3442; F01L 2001/34453; F01L 2001/34423; F01L 2001/34463; F01L 2001/34466
See application file for complete search history.

(56) References Cited

U.S. PATENT DOCUMENTS 5,704,317 A * 1/1998 Barth ..... F01L 1/34406 123/90.17
5,775,279 A 7/1998 Ogawa et al.
(Continued)

FOREIGN PATENT DOCUMENTS

CN 101802350 8/2010
CN 101883914 11/2010
(Continued)

*Primary Examiner* — Vicky A Johnson
(74) *Attorney, Agent, or Firm* — Davidson, Davidson & Kappel, LLC

(57) ABSTRACT

A hydraulic vane-type camshaft adjuster, having a stator and a rotor arranged therein such that the rotor can rotate during control mode, wherein the rotor and the stator form at least two working chambers and are separated by a vane. A locking pin immobilizes the rotor in a rotationally fixed manner in relation to the stator wherein the locking pin is connected to an active accumulator, which deflects the pin if required. The active accumulator is arranged below a rotation axis on a camshaft. A method is also provided.

10 Claims, 13 Drawing Sheets

(52) U.S. Cl.
CPC ..... *F01L 2001/34463* (2013.01); *F01L 2001/34466* (2013.01)

(56) References Cited

U.S. PATENT DOCUMENTS

| | | | | |
|---|---|---|---|---|
| 6,035,819 | A | 3/2000 | Nakayoshi et al. | |
| 7,536,985 | B2 | 5/2009 | Suzuki | |
| 7,874,274 | B2 | 1/2011 | Strauss | |
| 8,342,144 | B2 | 1/2013 | Busse et al. | |
| 8,833,318 | B2 | 9/2014 | Strauss et al. | |
| 8,931,451 | B2 | 1/2015 | Scheidig | |
| 2003/0188705 | A1* | 10/2003 | Aimone | F01L 1/022 123/90.34 |
| 2008/0283010 | A1 | 11/2008 | Bohner et al. | |
| 2009/0056656 | A1 | 3/2009 | Strauss et al. | |
| 2011/0162603 | A1* | 7/2011 | Busse | F01L 1/3442 123/90.17 |
| 2011/0239966 | A1* | 10/2011 | Strauss | F01L 1/344 123/90.15 |
| 2012/0152190 | A1 | 6/2012 | Kobayashi | |
| 2012/0210961 | A1* | 8/2012 | Scheidig | F01L 1/34409 123/90.15 |
| 2013/0000579 | A1* | 1/2013 | Schuseil | F01L 1/02 123/90.17 |

FOREIGN PATENT DOCUMENTS

| | | | |
|---|---|---|---|
| CN | 102713171 | | 10/2012 |
| DE | 10 2004 048 070 | A1 | 6/2006 |
| DE | 102007019307 | | 10/2007 |
| DE | 102009024482 | | 12/2010 |
| DE | 102009034512 | | 1/2011 |
| EP | 2492459 | | 8/2012 |
| EP | 2589793 | | 5/2013 |
| EP | 2708706 | | 3/2014 |
| JP | H09264110 | | 10/1997 |
| WO | WO 2012/171670 | A1 | 12/2012 |
| WO | WO2013031024 | | 3/2013 |

* cited by examiner

MULTI-LOCKING OF A CAMSHAFT ADJUSTER, AND METHOD FOR OPERATING A CAMSHAFT ADJUSTER

The present invention relates to a vane-type hydraulic camshaft adjuster, including a stator and a rotor situated rotatably in the stator during controlled operation, the rotor and the stator forming at least two working spaces, i.e., working chambers, which are situated between the rotor and the stator and separated by a vane fixed to the rotor, and which are fillable with hydraulic medium (such as oil) from a hydraulic medium supply device (such as an oil pump), at least one locking pin being present, which in the locking state fixes the rotor in a rotatably fixed manner with respect to the stator, the locking pin being connected to an active pressure accumulator which deflects the pin as necessary, and which is preferably separate from the hydraulic medium supply device.

BACKGROUND

A camshaft adjuster for a camshaft in a motor vehicle, such as a passenger vehicle, a truck. or a similar commercial vehicle, including an internal combustion engine is already known from the prior art, for example from WO 2012/171670 A1.

Moreover, the present invention relates to a method for locking a rotor of a hydraulic camshaft adjuster relative to a stator of the camshaft adjuster.

Similar methods are already known from DE 10 2004 048 070 A1. In the cited document, for example a method for operating a hydraulically actuated camshaft adjusting device or a hydraulically actuated device for changing the timing of gas exchange valves of an internal combustion engine of a vehicle is known, the internal combustion engine being controlled or regulated by a vehicle electrical system or vehicle electronics system, and the device including at least one electrically controlled hydraulic valve for influencing the flow of hydraulic fluid via the device, and in addition the at least one valve being acted on by a predefined current ($I_A$) during starting of the internal combustion engine, even before the idling speed is reached.

Also known from the prior art are center-locking concepts for camshaft adjusters which operate with two pins, i.e., two locking pins. The pins may also be referred to as pegs, bolts, or in general as blocking elements.

SUMMARY OF THE INVENTION

Previous center-locking concepts or end stop concepts always allow only one defined start position. However, in recent internal combustion engines/motors, various start positions may be necessary, depending on the starting state of the engine, which thus far has not or not easily been possible. While it was known previously only to lock the camshaft adjuster either in a retard position or an advance position or in an intermediate position, namely, the center locking position, the aim now is to be able to achieve at least two, or preferably three, locking positions. A suitable control for this purpose is likewise desirable.

It is an object of the present invention to depart from a center-locking concept prior to starting in order to set valve timing of the internal combustion engine in such a way that combustion processes according to the Miller principle or the Atkinson principle become possible. According to the Atkinson principle, the intake valve closes very late, while according to the Miller principle it closes very early, namely, during the intake. In both cases, this results in a reduced cylinder charge, and due to the shorter effective compression stroke results in increased efficiency in both cycles. Now, however, an internal combustion engine with such reduced compression is not always startable under all operating conditions. A remedy may now be provided for this situation.

In particular when the internal combustion engine has not yet reached its operating temperature, i.e., the cooling water has not yet reached between 80° C. and 100° C., good starting capability of the engine should nevertheless be achieved. In addition, the engine should be fireable with only minimal emissions. On the other hand, good starting behavior should also be ensured with start/stop systems, which are currently commonplace.

Lastly, the aim is to avoid the disadvantages known from the prior art, and to allow a starting operation in the cold state ("key on start") in use in recent internal combustion engines, which are increasingly being equipped with start/stop automatic systems, for example with preselection of a center locking position, but also during a cold start. Adequate compression should always be provided in the combustion chamber.

While the ideal start position during an automatic start/stop-start in the warm state requires a start position in the retard position or the advance position, i.e., the corresponding locking position, means should be available to allow an efficient operation in this case. Therefore, not until the start phase of the internal combustion should the best start position be achieved, as a function of the temperature state of the engine.

Various start positions should thus be preselectable as a function of the state of the internal combustion engine. The aim is to provide a camshaft adjuster which during starting may assume one desired position of at least two locking positions, controlled by the control electronics system of the engine.

For a generic hydraulic camshaft adjuster, this object is achieved according to the present invention in that the active pressure accumulator is situated below a rotation axis of a camshaft which is connectable to the rotor. The term "below" is understood to mean an arrangement which is defined by gravity.

It is advantageous when the locking pin and the active pressure accumulator are interrelated with one another in such a way that the locking pin is inhibited from rotatably fixing the rotor relative to the stator.

It is advantageous when the active pressure accumulator includes a storage space for hydraulic medium, such as oil, which is reducible in size with the aid of a deformable piston, for example, and from which the hydraulic medium is transferable via a pressure medium line into the interior of a rotor, for example through the interior of the camshaft.

It is also advantageous when an outlet of the storage space, and preferably also the storage space itself, are situated below an outlet of the pressure medium line, for example below a lower edge of the camshaft, in particular in the area of the feed of the hydraulic medium to the camshaft. In this way, the active pressure accumulator may be prevented from running dry, and a rapid start-up of the adjustment kinematics may be forced.

It is particularly advantageous when not just one locking pin, but, rather, two or even more locking pins are used. It is then unnecessary to decelerate a rotary motion of the rotor relative to the stator during locking, resulting in more precise locking.

The locking may be efficiently regulated or controlled when the active pressure accumulator is designed in such a way that it is set up to discharge hydraulic medium based on a control signal, such as an electrical signal converted by a switching valve.

It is also advantageous when the storage space has a volume $V_1$ which is greater than volume $V_{line}$ of the line section from the outlet of the storage space to the working spaces plus volume $V_{VCP\ chamber}$ of the working spaces. It is thus ensured that sufficient oil is always present for rotating the rotor relative to the stator or for preventing the locking pin from retracting, even when the internal combustion engine is not running. The oil line between the active pressure accumulator and the adjuster should be preferably short, since an oil volume that is kept small allows quicker filling of the line. During the engine start-up, the line should be separated from the remainder of the lubrication system, for example with the aid of a check valve in the actual supply line.

It has proven to be particularly advantageous when a central valve is inserted into the rotor, via which hydraulic medium of the active pressure accumulator is suppliable to the working spaces and/or to a link which is designed for accommodating the locking pin. On the one hand, rotation of the rotor may thus be forced, and on the other hand, skipping of a locking position, such as the center locking position, may be achieved by the locking pin(s). A transition from an advance locking position to a retard locking position is thus likewise possible.

If two locking pins are present which are retractable into a link, for example into a center locking link, a center locking position may be easily fixed by the pins.

It is also advantageous when, additionally or alternatively, one of these locking pins is retractably supported in a further link, the links being separate from one another. This further link may be a retard locking link or an advance locking link, i.e., may achieve a retard locking position or an advance locking position. The center locking position is also referred to as midlock position (MLP), the position determined by the retard locking position being understood as the retard position. The advance locking position may also be referred to as the advance position.

To allow good regulation/control capability of the camshaft adjuster, it is advantageous to insert a 5/5-way valve or a 4/3-way valve and a 3/2-way valve between the working spaces and the active pressure accumulator.

One advantageous exemplary embodiment is characterized in that the rotor is fixable relative to the stator in a rotatably fixed manner in an advance position and/or retard position and/or center position via the locking pins.

It is advantageous when the rotor is lockable or locked in a rotatably fixed manner in a position on the stator which is rotated at least 5 degrees from the retard position.

Moreover, the present invention relates to a method for locking a rotor of a hydraulic camshaft adjuster relative to a stator of the camshaft adjuster, the rotor being lockable with respect to the stator in a center position and also in an advance position or retard position via at least one locking pin, and a hydraulic medium of an active pressure accumulator, which is separate from a hydraulic medium supply device provided for filling working chambers between the rotor and the stator, being utilized for influencing a rotary motion of the rotor.

It is also advantageous when the hydraulic camshaft adjuster according to the present invention is used in such a method.

In addition, it is advantageous when the hydraulic medium of the active pressure accumulator is utilized for influencing a longitudinal motion of the locking pin and/or for preventing the locking pin or multiple locking pins from retracting into a center locking link.

In other words, a camshaft adjuster design is provided which allows two or more locking positions, and which provides a strategy in the engine control unit which, with the aid of an active pressure accumulator, allows a change in the position during the engine start-up. Problems with unlocking, which occur with camshaft adjusters which utilize a single conical pin, are prevented. In particular, the use of two locking pins is advantageous here, even though a minimum play always remains. The locking pins may be distributed over the circumference. However, the locking pins should not be situated exactly 180 degrees opposite from one another, since disadvantages arise when the locking play is too great. This is due to the fact that the manufacturing tolerances are additive. Nevertheless, the two locking pins should have at least a certain distance from one another, viewed over the circumference.

Two locking pins are advantageous which lock axially into a center locking link by spring action when the angle between the rotor and the stator allows this. In this locked-in state, these two locking pins block the movement of the rotor in the direction away from the center position/center locking position.

One of these two locking pins may also lock into a locking link situated at the late stop of the adjustment range, or alternatively, the other locking pin may lock into a locking link situated at the early stop of the adjustment range.

The hydraulic medium supply, for example the oil supply, to the center locking link is controlled via a 5/5-way valve. The oil supply to the retard locking link is controlled via a so-called A chamber of the adjuster. Alternatively, this would also be possible for the locking link in the advance position, and the supply could also be provided from a B chamber.

To allow a change of the locking position either from the center position to the retard/advance position, or from the retard/advance position to the center position, during the start phase when the motor/internal combustion engine is started, the present invention utilizes an active pressure accumulator which is designed in such a way that it may store engine oil, even during a fairly long standstill phase, and is unlocked when the engine is started, so that this stored oil volume allows activation of the unlocking in one position, and the movement toward the other position.

For controlling the unlocking, movement, and renewed locking operation, a strategy for energizing the actuator, such as a magnet, is possible, as described in greater detail below.

To ensure that a sufficient oil quantity is retained in the pressure accumulator, the pressure accumulator should be situated below the camshaft axis, and all supply and discharge lines should lead from above to the pressure accumulator to prevent the pressure accumulator from running dry. The volume of the pressure accumulator must be selected in such a way that enough oil remains to fill the working chambers/working spaces (variable camshaft phaser chambers) and their supply channels which have run dry, compensate for leaks, and allow at least one complete adjustment movement. If the active pressure accumulator is present below a supply area of a camshaft adjuster, in particular of a camshaft, seals may be dispensed with, so that when the internal combustion engine is at a standstill the oil does not escape at the same location, and the active pressure accumulator does not run dry.

In other words, an integration of an active pressure accumulator, which may be switched on and off, into a camshaft adjuster system is provided. When the internal combustion engine/the motor is switched off, the camshaft adjuster is to be moved to the advance position by the control unit strategy. When the internal combustion engine is restarted, the friction of the camshaft drags the camshaft adjuster in the direction of the retard position. Locking now takes place there when the pressure accumulator is not switched on and the locking mechanism has arrived at the center locking position.

When the pressure accumulator, which is connected to the detent recesses/links for the locking pins/latching pins via channels, is switched on, the oil flowing from the pressure accumulator inhibits the locking pins from locking in the center position. The center position is "overrun," as the result of which the camshaft adjuster passes completely through, and locks there only at the late stop.

The connection of the locking pin detent recesses to a "normal" C oil channel may be enabled by a switching valve.

Lastly, at least two locking positions are assumed by the camshaft adjuster, one of which is a retard locking position. The active pressure accumulator is chargeable by the engine oil system, and may be switched on or off by an electrical control system. A switching valve may be used which may switch the oil flow, which is controlled by the control system of the camshaft adjuster for controlling the locking pin, on and off.

An electrical camshaft adjuster may be replaced, thereby reducing the costs in relation to the electrical camshaft adjuster by several times. Efficient camshaft adjusters may now be manufactured in large numbers and used in internal combustion engines.

BRIEF DESCRIPTION OF THE DRAWINGS

The present invention is explained in greater detail below, also with the aid of drawings in which various exemplary embodiments are illustrated.

DETAILED DESCRIPTION

Figure 1:
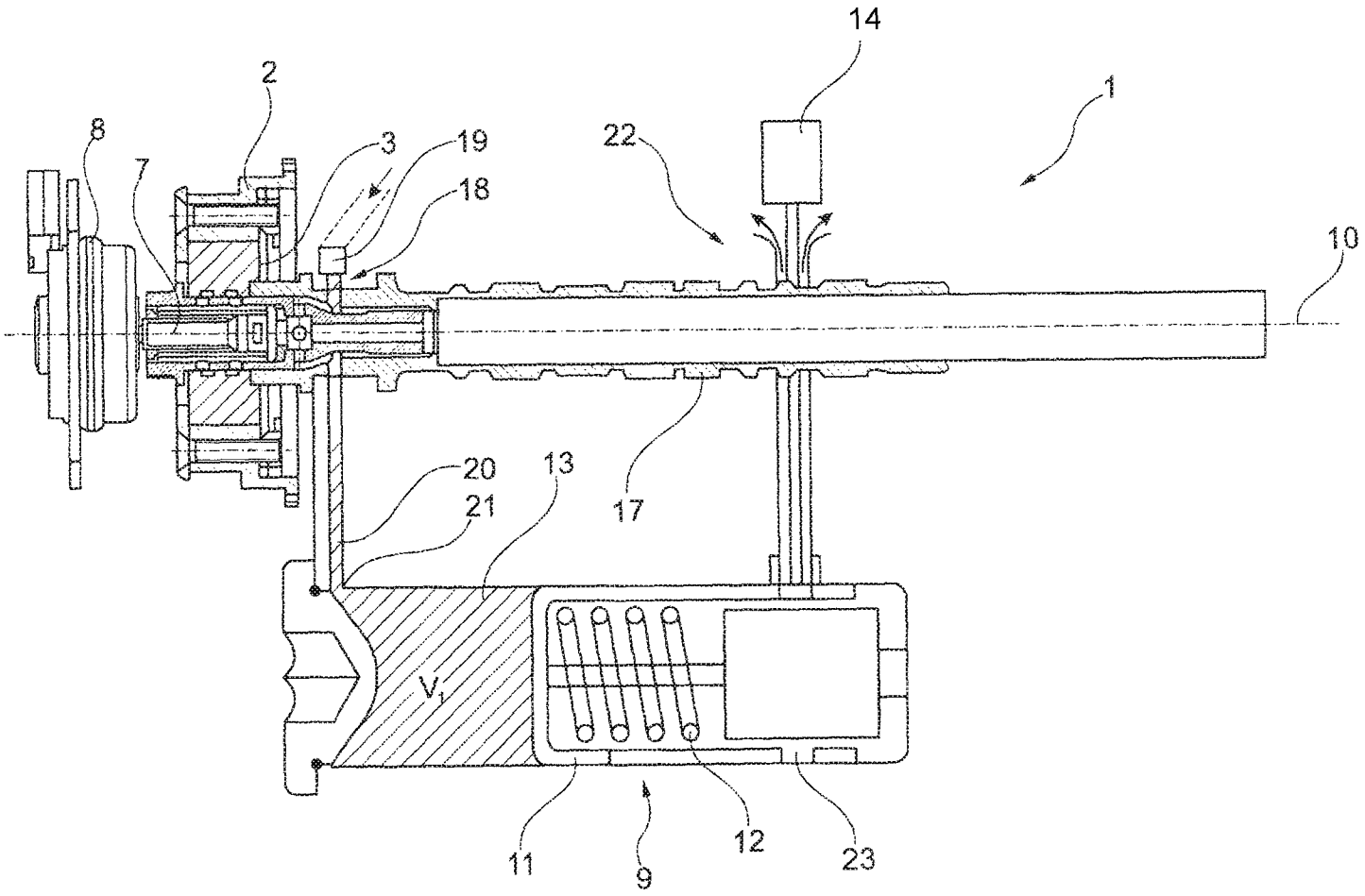
FIG. 1 shows the arrangement of an active pressure accumulator in a hydraulic camshaft adjuster according to the present invention, in a longitudinal sectional view.

The figures are strictly schematic in nature, and are used only for understanding of the present invention. Identical elements are provided with the same reference numerals.

FIG. 1 illustrates a first specific embodiment of a hydraulic camshaft adjuster 1 according to the present invention. The camshaft adjuster is a vane-type hydraulic camshaft adjuster, i.e., includes a stator 2 and a rotor 3, between which vanes or pressure chambers 4 are formed. These pressure chambers 4 are not discernible in FIG. 1. However, one of pressure chambers 4 is discernible in FIGS. 2 and 3. It is also apparent in FIGS. 2 and 3 that each pressure chamber is divided by a vane 5 which is mounted on rotor 3 in a rotatably fixed manner, thus forming working chambers 6. One working chamber 6 is referred to as retard working chamber A, and the other is referred to as advance working chamber B. Working chamber 6 may also be referred to as a working space.

Returning to FIG. 1, a central valve 7 is screwed into rotor 3. Central valve 7 is controlled via a central magnet 8, namely, a proportional magnet. Oil supply channels for working chambers 6 are opened by the control system. Oil may then be transferred into working chambers 6, or oil may be removed from working chambers 6, by a pump element, not illustrated, of a hydraulic medium supply device (not illustrated), such as an oil pump. For this purpose, a receiving element such as a tank or an oil pan is also connected.

However, an active pressure accumulator 9 is also provided here. Pressure accumulator 9 is situated below a camshaft rotation axis 10. Camshaft rotation axis 10 may also be referred to as "rotation axis" for short.

Active pressure accumulator 9 includes a piston 11 which is pretensioned via a spring 12. Spring 12 pretensions piston 11 in the direction of a storage space 13. Storage space 13 has a volume $V_1$. An actuator 14 is provided for unlocking or locking active pressure accumulator 9. Actuator 14 may also be designed as a switching valve. It may also be designed as a solenoid valve. When energized, actuator 14 effectuates unlocking of piston 11, which is used for compression.

A camshaft 17 is provided for connection to rotor 3 in a rotatably fixed manner. A valve 19 is provided at a slide bearing point 18 in order to interrupt an oil supply from the oil pump. A pressure medium line 20 is present for connecting an outlet 21 of storage space 13 to slide bearing point 18 and allowing oil access into the interior of camshaft 17. The oil from the interior of the camshaft may then penetrate into the interior of central valve 17, and may reach working chambers A or B through inlets which are opened as necessary. The supply from oil pump P is in particular from the top (but is also possible from other directions), i.e., on the top side of camshaft 17 at the slide bearing or at slide bearing point 18, while the supply from active pressure accumulator 9 is at the bottom, at slide bearing point 18.

Ventilation 22 is also provided to be able to remove air from a spring chamber 23 or to draw air back into the spring chamber when the piston presses oil from pressure accumulator 9.

Figure 2:
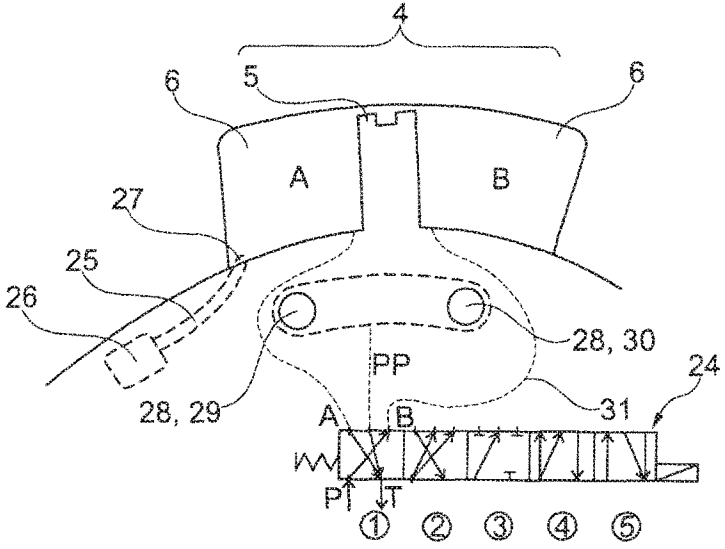
FIG. 2 shows the interconnection of a 5/5-way valve which includes two working chambers, which form a pressure chamber that is divided by a vane.

FIG. 2 illustrates the use of a 5/5-way valve 24. 5/5-way valve 24 includes five inlets/outlets and five positions which the valve may assume during the adjustment. The inlets/outlets lead to hydraulic medium supply device P, a tank T, working chamber A, a center locking link 31, and working chamber B. The center locking position (MLP) is illustrated in FIG. 2. A connection 25 between working chamber A and a retard locking link 26 is present. For this purpose, working chamber A has an extra opening area 27.

Figure 3:
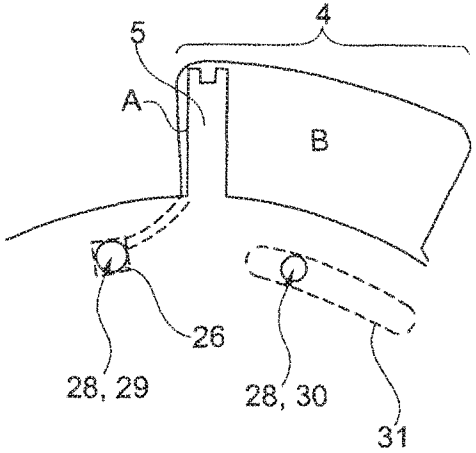
FIG. 3 shows the interconnection from FIG. 2, but with the vane arrived in a retard position.

While FIG. 2 illustrates the center locking position, FIG. 3 illustrates the retard locking position. Two locking pins 28 are present. One of the two locking pins 28 is referred to as first locking pin 29, and the other of the two locking pins 28 is referred to as second locking pin 30. In the situation in FIG. 2, both locking pins 29 and 30 are locked into a center locking link 31. In the state in FIG. 3, first locking pin 29 is locked into retard locking link 26, and second locking pin 30 is locked into center locking link 31. Thus, there is a form fit at the positions of the two links 26 and 31 with locking pins 29 and 30, respectively.

Figure 4:
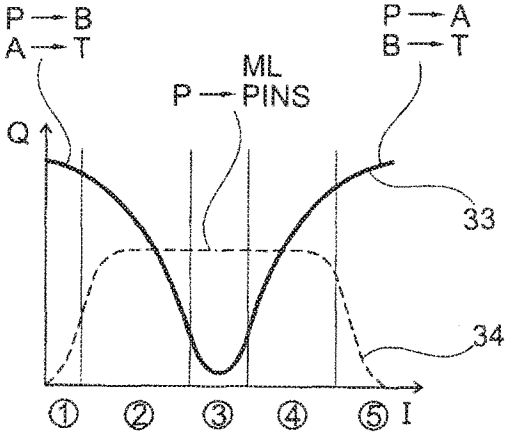
FIG. 4 shows a volume flow/electrical control current diagram on which the control of the 5/5-way valve, as used in the exemplary embodiment according to FIG. 2, is based.

FIG. 4 illustrates a flow rate/current diagram, with electric current I plotted on the horizontal axis and hydraulic medium flow rate Q plotted on the vertical axis. At the far left end of the diagram, hydraulic medium supply device P, which is a component that is separate from active pressure accumulator 9, is connected to working chamber B, whereas working chamber A is connected to the tank. At the far right edge of the diagram, hydraulic medium supply device P is connected to working chamber A, and working chamber B is connected to the tank.

Figure 6:
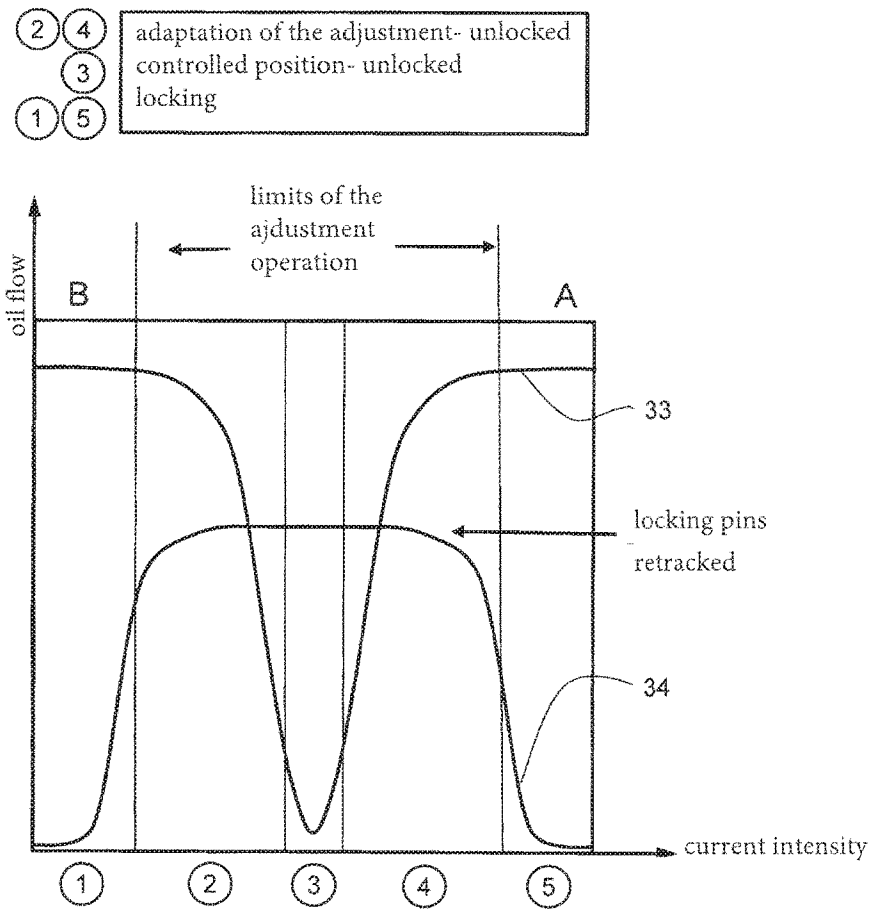
FIG. 6 shows a hydraulic medium flow rate/electrical control current diagram, similar to the diagram from FIG. 4, which is used for supplying the central valve from FIG. 5 with oil.

Five areas 1, 2, 3, 4, and 5 are discernible in the diagram, and are also illustrated in FIG. 6. A locking command/a locking instruction is present in areas 1 and 5. In segments 2 and 4, no locking is achieved, and in addition no hydraulic clamping of vane 5 is effectuated. However, the hydraulic clamping of vane 5 is forced in an area 3.

These areas 1 through 5 are predefined by the switch positions of 5/5-way valve 24, as illustrated in FIG. 2.

A center locking position without locking pins 29 and 30 retracted is effectuated in settings 1 and 5 of 5/5-way valve 24.

Separate from 5/5-way valve 24, a 4/3-way valve in addition to a 3/2-way valve is also possible. A separate valve is thus used for supplying center locking link 31, which is designed as an elongated hole.

Figure 5:
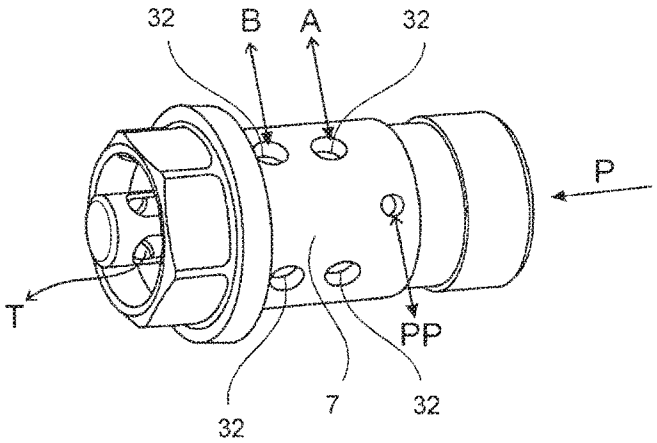
FIG. 5 shows a perspective illustration of a central valve used in the hydraulic camshaft adjuster according to the present invention.

FIG. 5 illustrates central valve 7 and openings 32 therein. The supply of working chambers A and B, of pressure medium line PP, and of tank T, and the feed from hydraulic medium supply device P, are also indicated. Volume flow rate curve 33 for hydraulic fluid through the working chambers is denoted by reference numeral 33, whereas the (volume) flow rate curve through channel PP to pressure medium line 20 is provided with reference numeral 34. The activation of locking pins 28 is thus predefinable as a function of flow rate curve 34.

Figure 7:
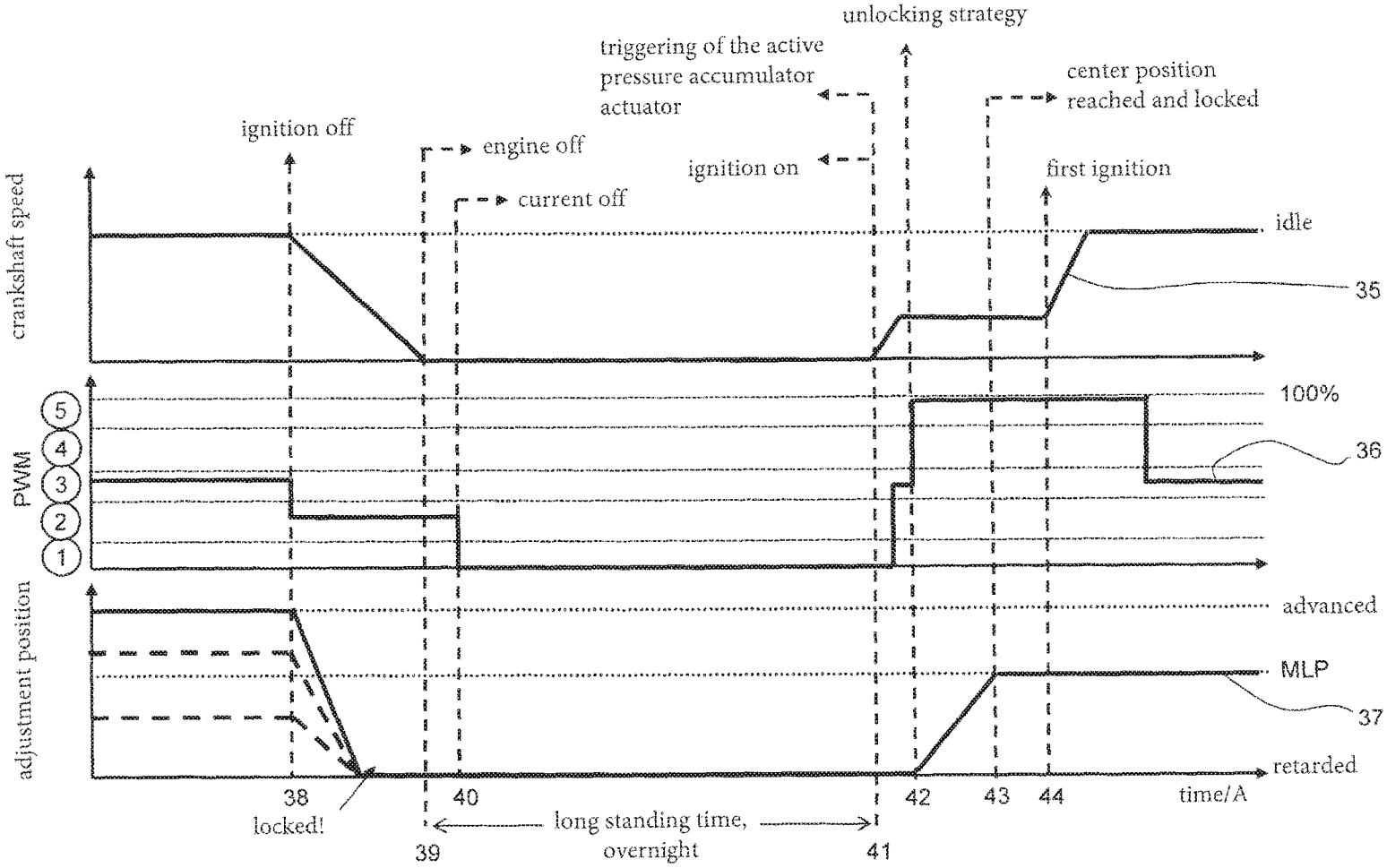
FIG. 7 shows an overall diagram made up of three partial diagrams for a center locking strategy when the internal combustion engine is stopped, at which point in time locking in the retard position is achieved, and in which a departure is made from the retard locking position for an extended period of time after the internal combustion engine has cooled down, and a center locking position is sought when the engine is restarted.

The chronological sequence of the crankshaft speed (uppermost part of the diagram), the pulse duty factor/pulse width modulation state (PWM for short) in the middle part, and the angular position of the camshaft adjuster (phaser position) in the lower area are plotted on the horizontal axis in FIG. 7. The crankshaft speed is depicted by line 35. The pulse duty factor is depicted by line 36. The locking state is depicted by line 37.

A state in the locking of a center position MLP, a retard position (Ret.), i.e., late position, and an advance position (Adv.), i.e., early position, is possible. At point in time (t), at which the ignition key is turned and the internal combustion engine is switched off, namely, point in time 38, the rotational speed of the crankshaft changes. The internal combustion engine is at a standstill at point in time 39. Current flow is no longer present, i.e., electric current no longer flows, at point in time 40. Approximately 10 minutes or even eight or more hours after point in time 40, the ignition key is turned at point in time 41, and at the same time, oil stored in active pressure accumulator 9 is conveyed into central valve 7. The unlocking strategy, as already provided, is run through at point in time 42. The center locking position is reached at point in time 43, since in this position the two locking pins 29 and 30 are in locking engagement at this point in time.

Only at point in time 44 does ignition take place. This is the point in time of the so-called "first ignition."

Figure 8:
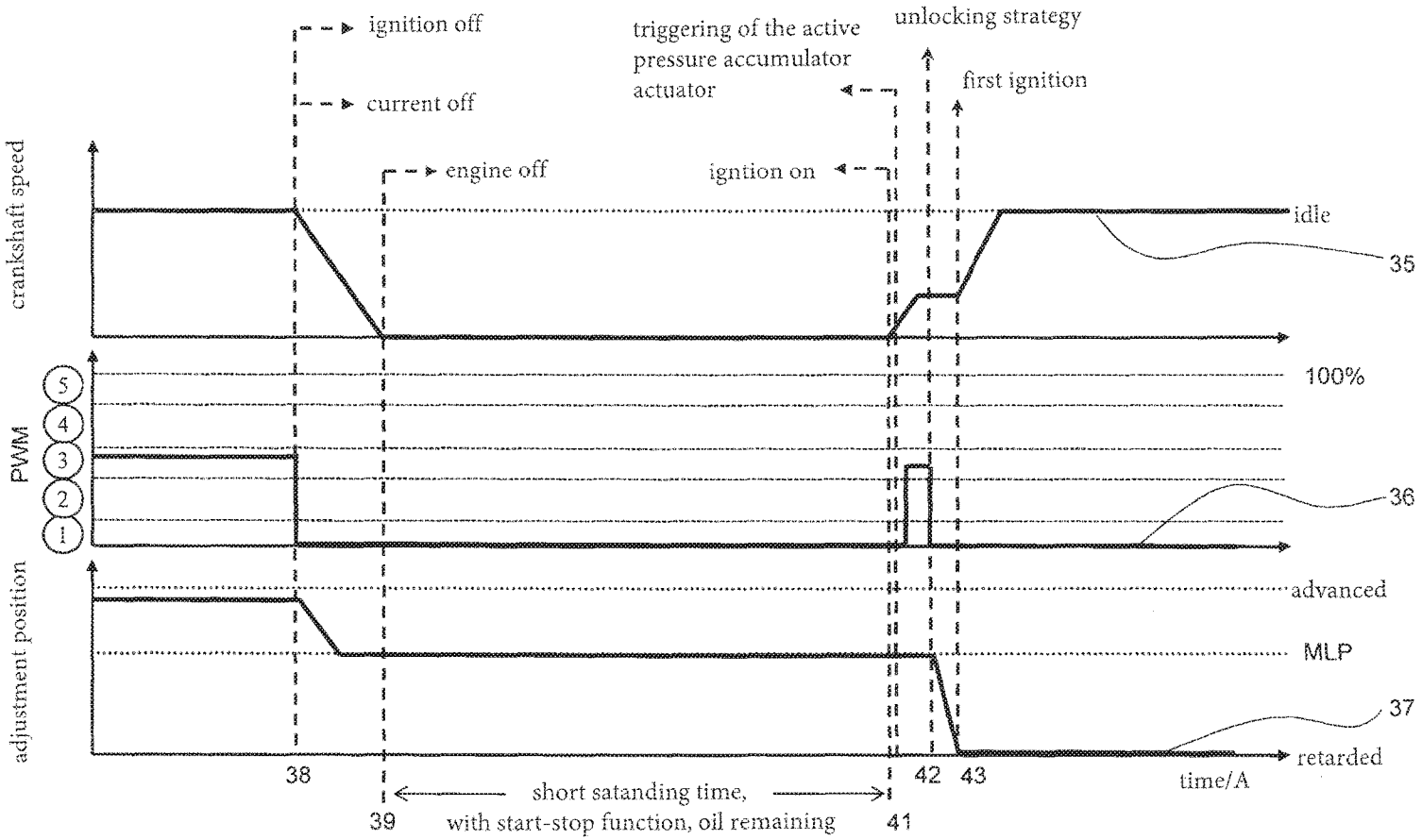
FIG. 8 shows an illustration, comparable to FIG. 7, of an overall diagram, but with the engine not cooled down and a customary start/stop-restart situation present, whereby a center locking position that is achieved when the internal combustion engine is switched off is triggered, and a retard locking position is preselected for starting the engine.

FIG. 8 illustrates another state, namely, a state in which less than approximately eight hours time has elapsed between points in time 39 and 41, at least enough time that the motor or the internal combustion engine has not yet cooled down, and at least has not cooled below 100° C. or 80° C. This is the state of normal start/stop operation.

Figure 9:
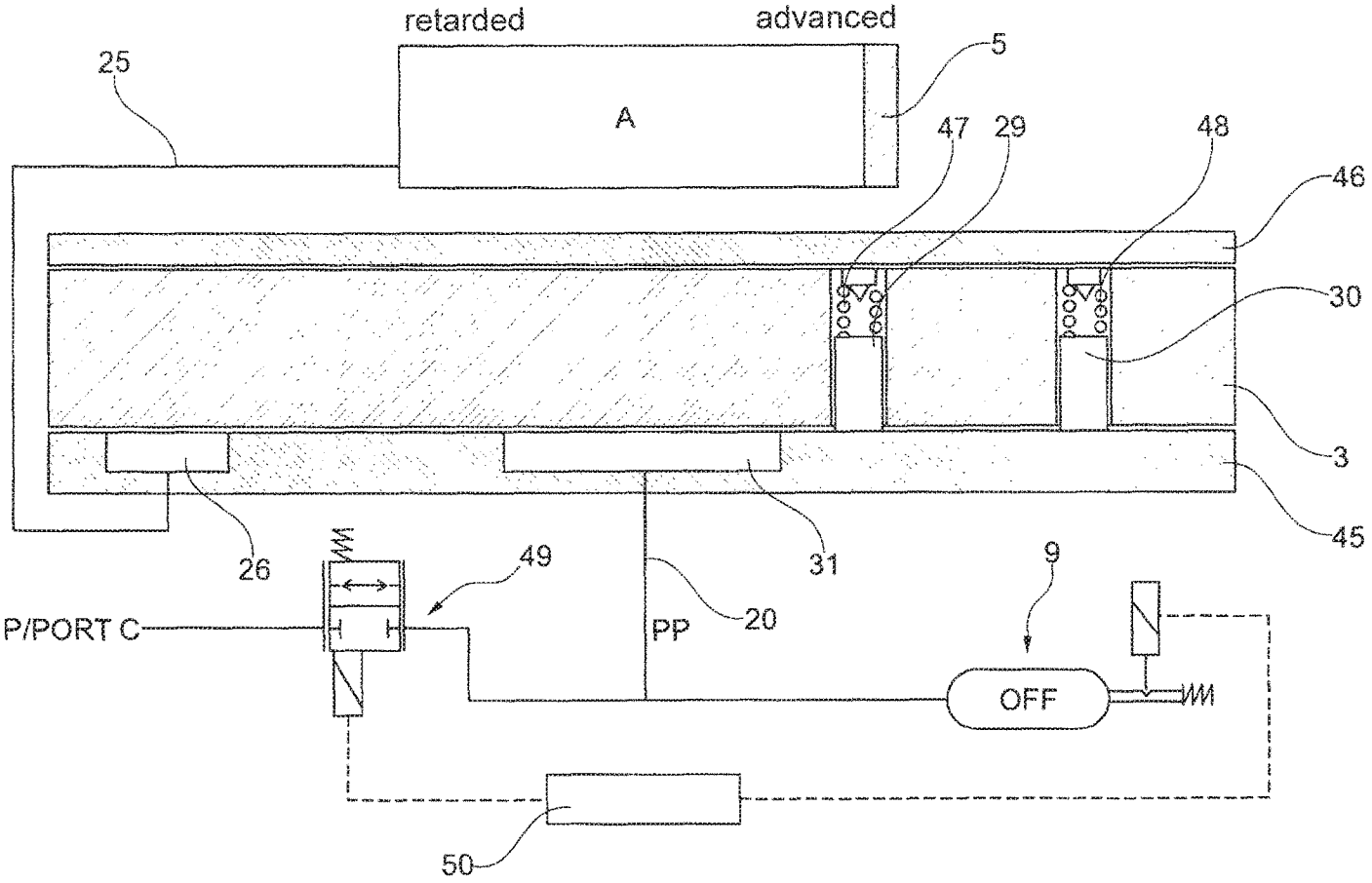
FIGS. 9 through 12 show the transition from an advance position into a retard locking position, with passing into a center locking position when the engine is started.

FIG. 9 shows an active pressure accumulator 9, which is connected via pressure medium line 20 (PP) to center locking link 31 in a locking cover 45. Center locking link 31 is on the other side of a sealing cover 46, viewed from rotor 3. Locking pins 29 and 30 are inserted into rotor 3 with pretension via springs 47 and 48. Vane 5 is in its advance position, so that working chamber A has a maximum size. A switching valve 49 is connected to hydraulic medium supply device P (port C). However, switching valve 49 is in such a position that inflow from P to active pressure accumulator 9 and also to pressure medium line 20 is interrupted. A control unit 50 is used in this regard.

Figure 10:
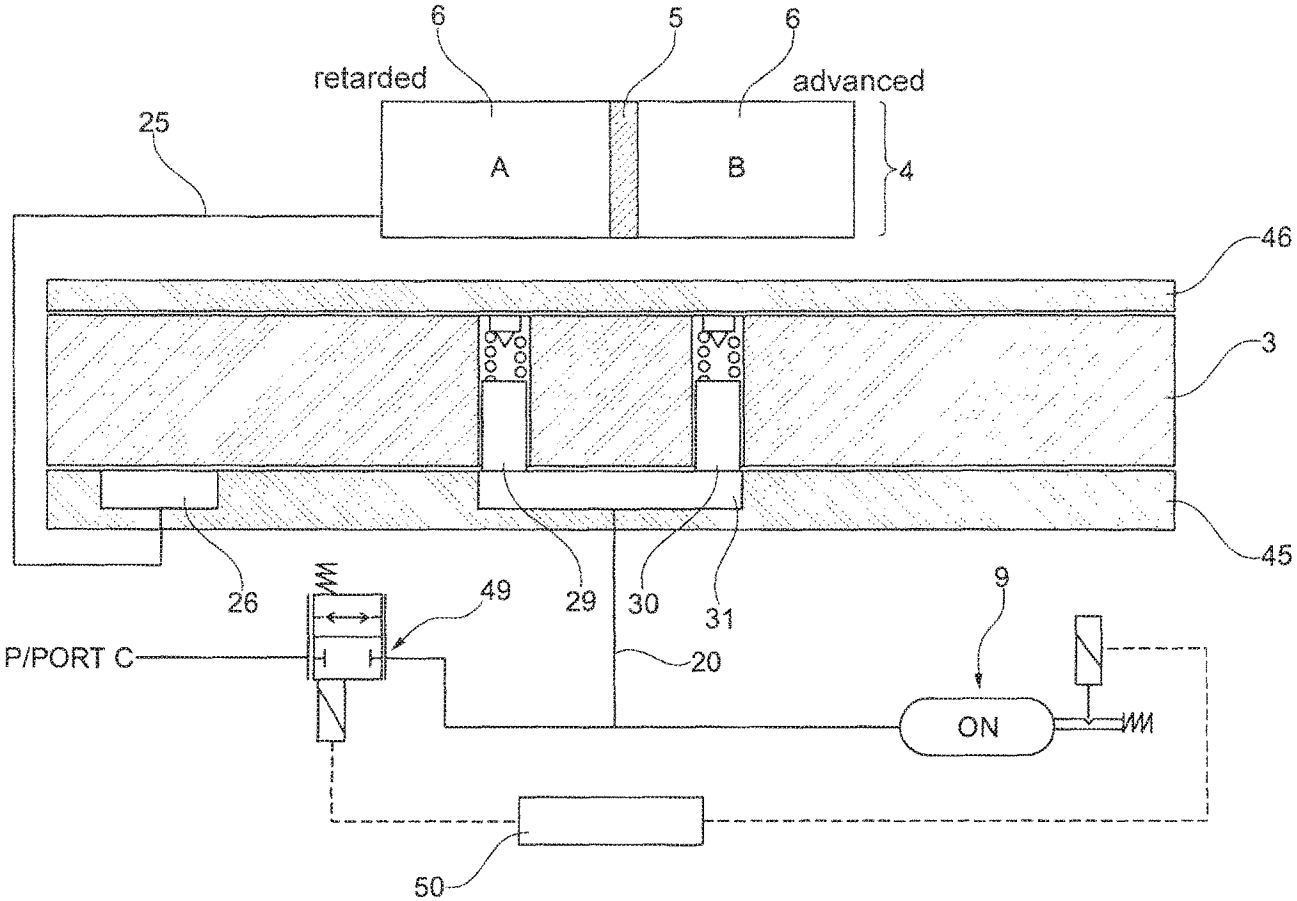

In FIG. 9, rotor 3 is in an advance position prior to the engine start-up. In FIG. 10, the rotor is already in a center position, oil pressure being provided by active pressure accumulator 9 via pressure medium line 20 in link 31.

While pressure accumulator 9 is not switched on (i.e., is off) in FIG. 9, in the state in FIG. 10 it is switched on (i.e., on).

Figure 11:
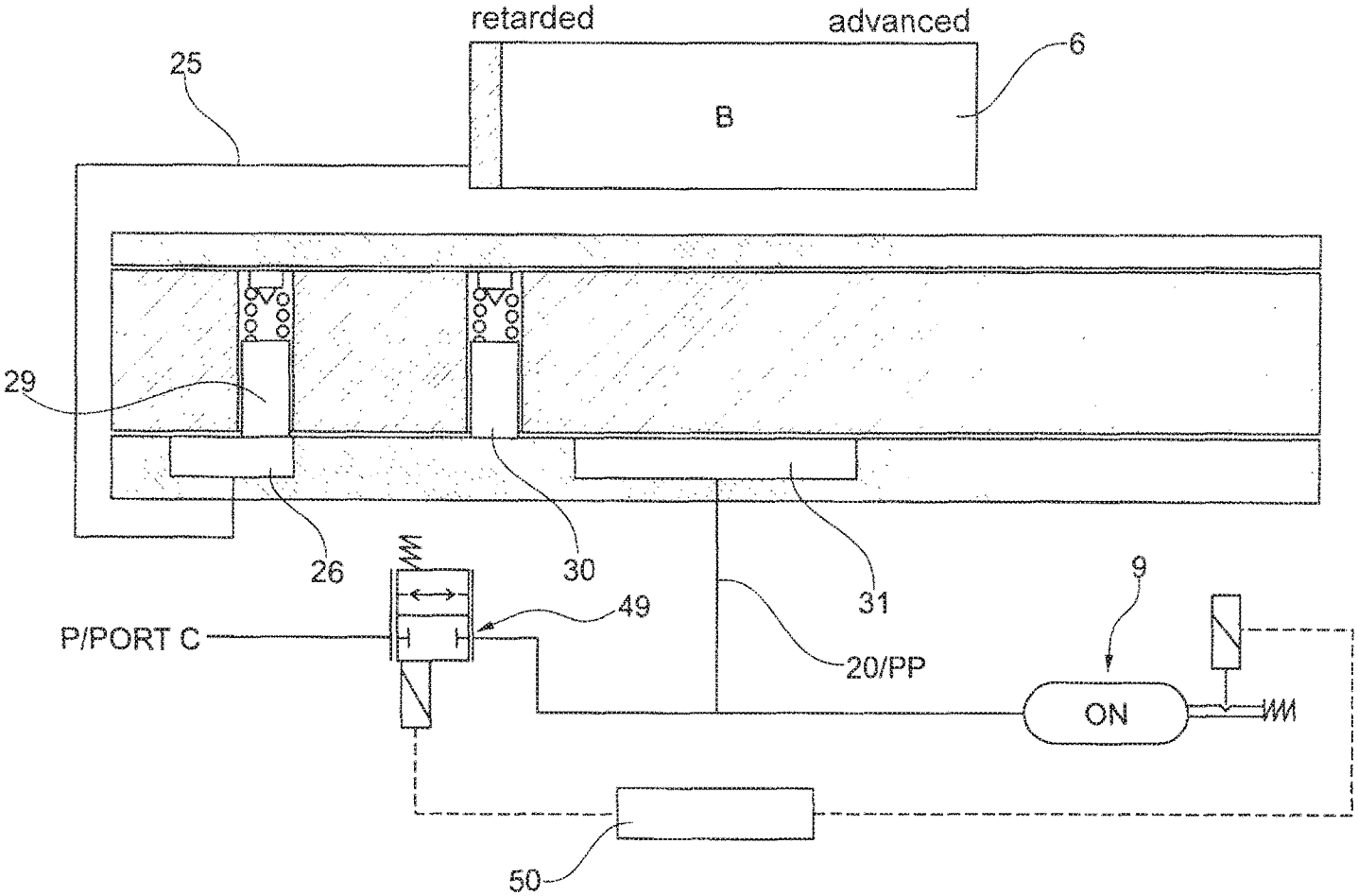
Figure 12:
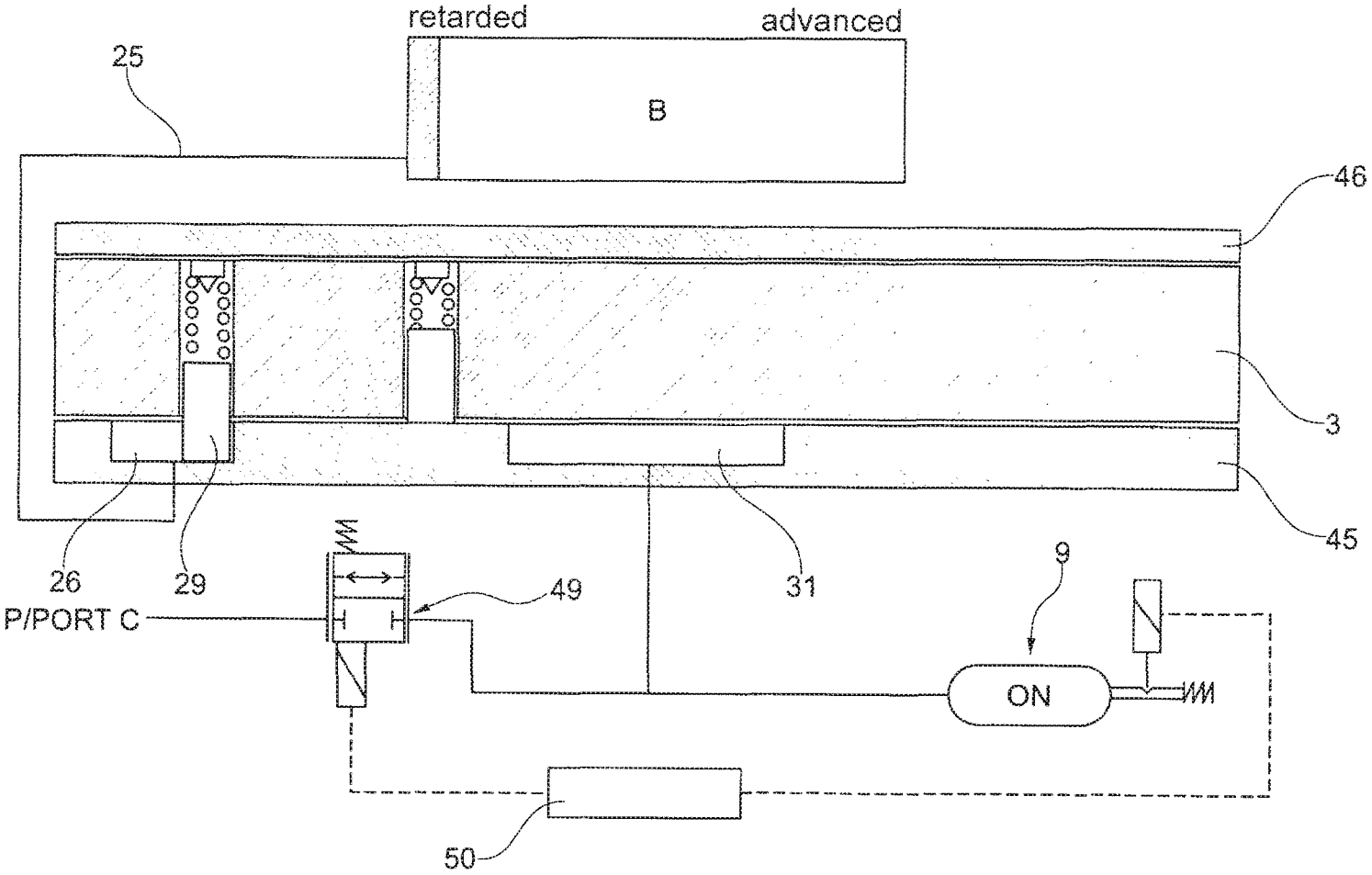

In the exemplary embodiment of the chronological state according to FIG. 11, rotor 3 has already arrived at its retard position. Locking link 31 has thus been "overrun." FIG. 12 illustrates the state in which locking pin 29 is now in locking engagement with locking link 26.

Figure 13:
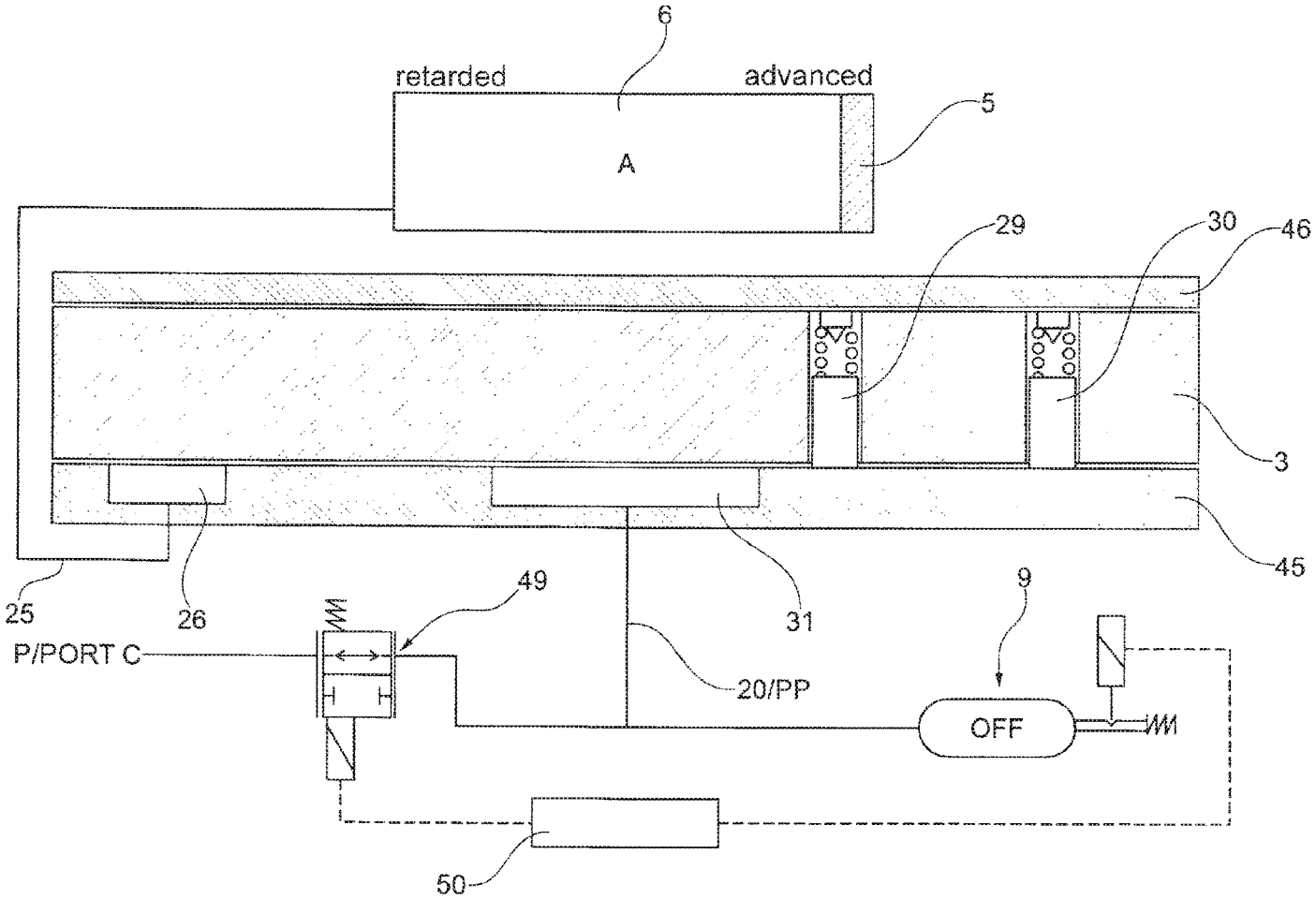
FIGS. 13 through 16 show the sequence of switching off the engine in an advance position, and transferring the rotor into a center locking position for restarting the internal combustion engine.
Figure 14:
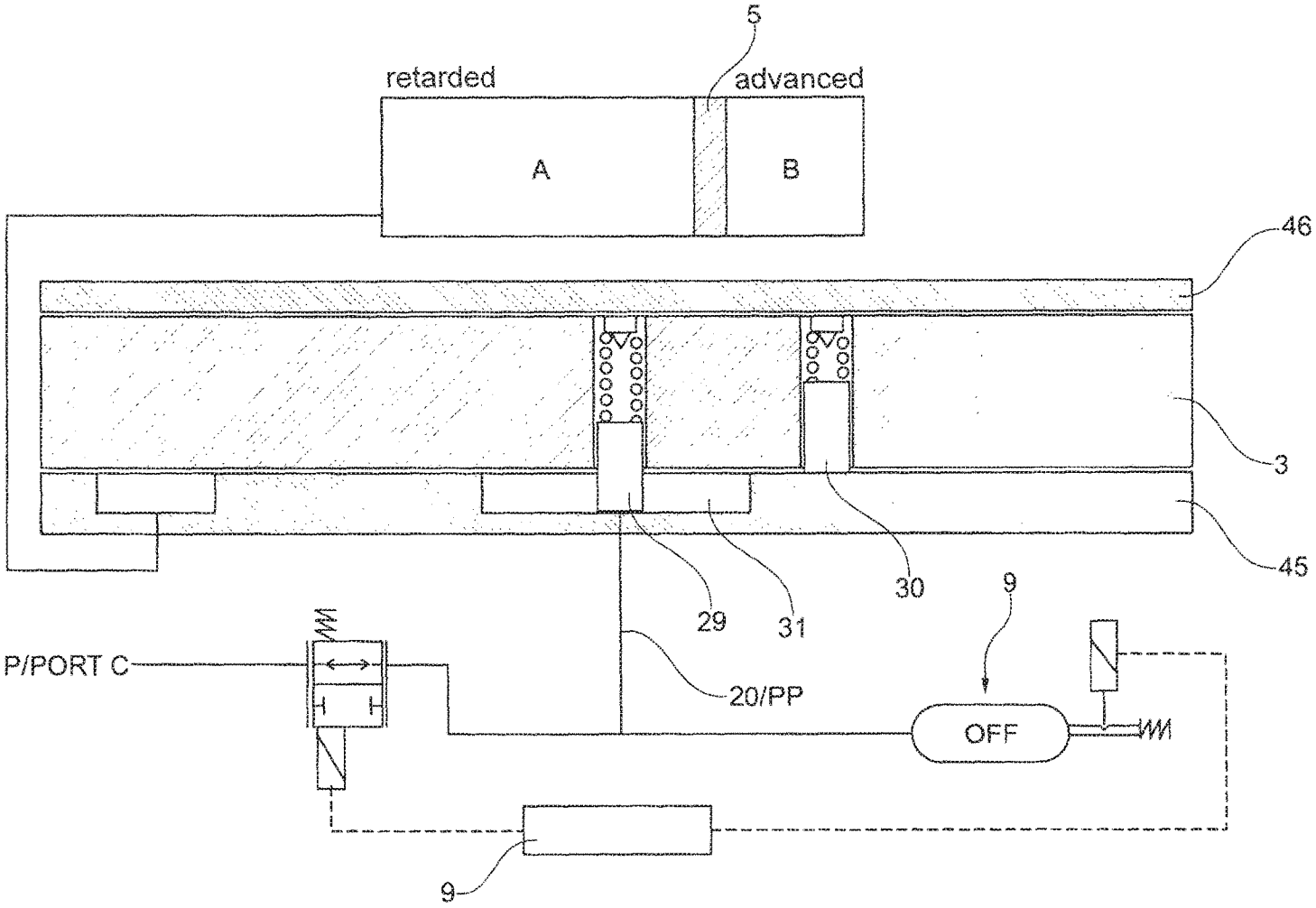

In a second variant, rotor 3 is illustrated in FIG. 13 in its advance position prior to the engine start-up. The rotor is once again situated between locking cover 45 and sealing cover 46. Active pressure accumulator 9 is not yet connected via pressure medium line 20 (PP), and is thus still "off." Rotor 3 is between its advance position and the center position in the state illustrated in FIG. 14. However, first pin 29 has already retracted into locking link 31, and makes locking engagement there. Active pressure accumulator 9 is still "off." However, as likewise illustrated in FIG. 13, switching valve 49 is not connected to port C, i.e., pump P.

Figure 15:
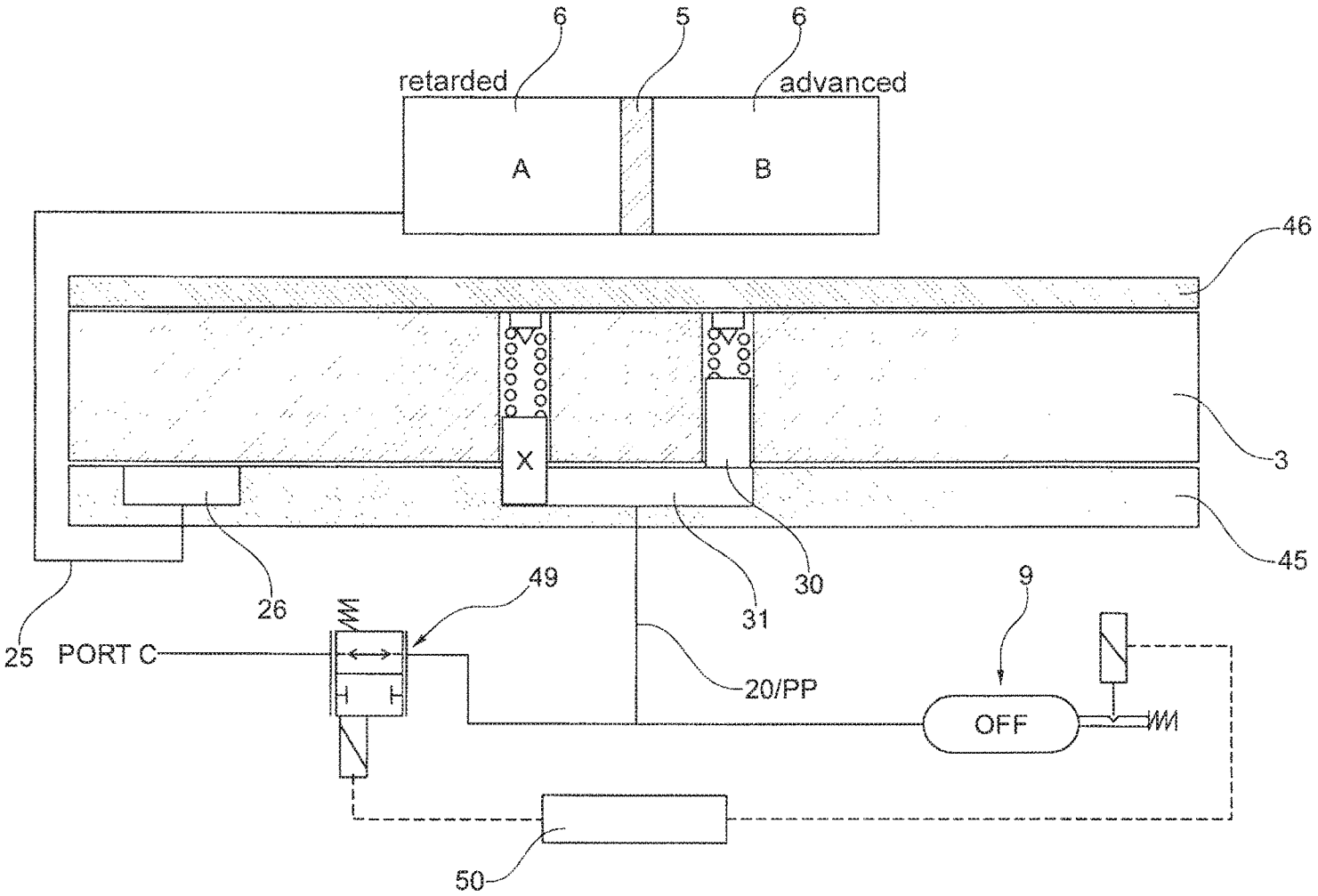

FIG. 15 illustrates the chronologically subsequent state in which second locking pin 30 now also retracts into locking link 31.

Figure 16:
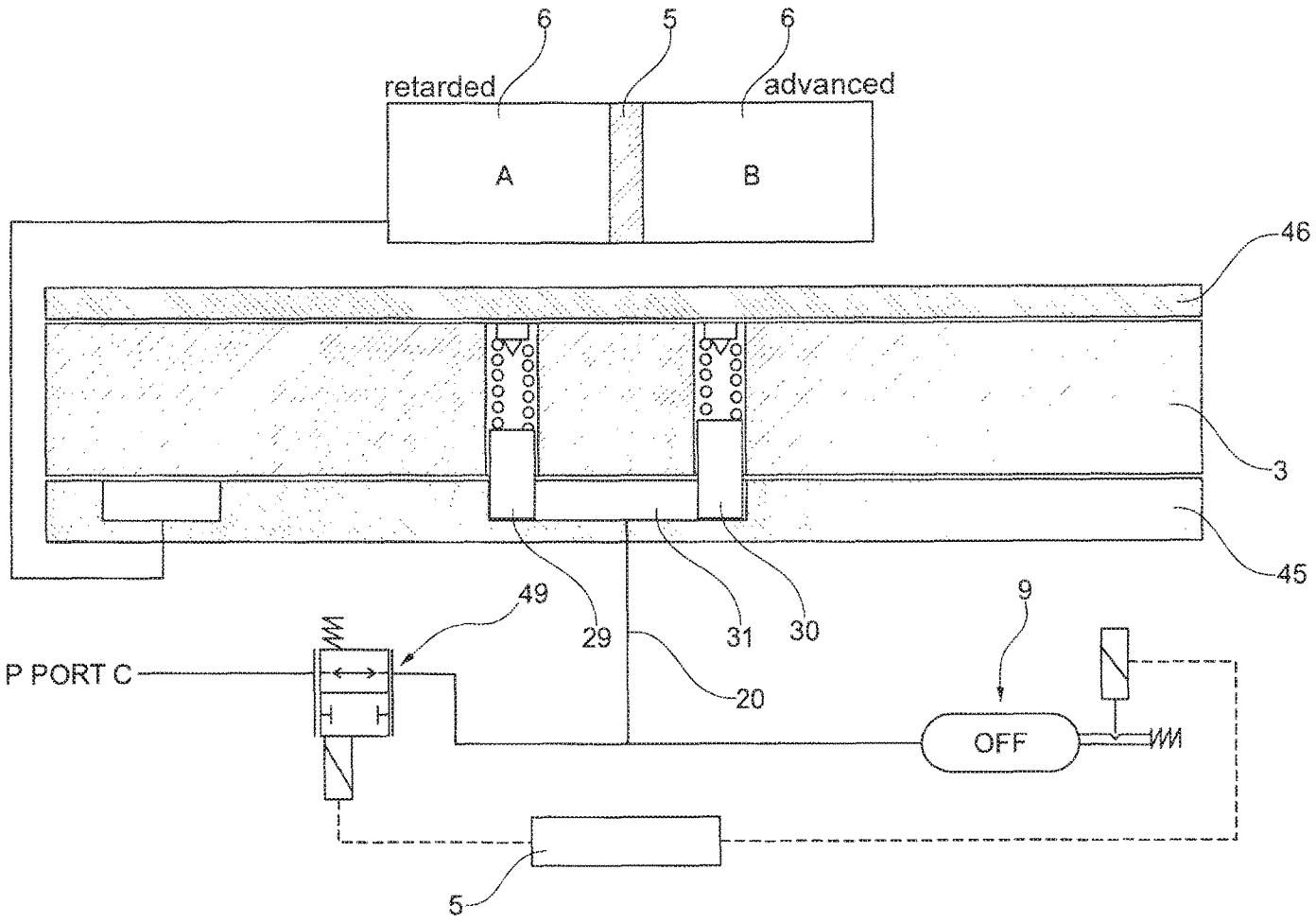

In FIG. 16, second locking pin 30 is now also lockingly retracted into link 31, so that rotor 3 is now locked in its center position by locking pins 28. Switching valve 49 may also be connected through when, instead of a 5/5-way valve in position 1, the variant of the 4/3-way valve and 3/2-way valve use, already disclosed, is also desired.

LIST OF REFERENCE NUMERALS

1 camshaft adjuster
2 stator
3 rotor
4 vane/pressure chamber
5 vane
6 working chamber (retard working chamber A/advance working chamber B)
7 central valve
8 central magnet
9 active pressure accumulator
10 camshaft rotation axis
11 piston
12 spring
13 storage space
14 actuator
17 camshaft
18 slide bearing point
19 valve
20 pressure medium line
21 outlet of storage space
22 ventilation
23 spring chamber
24 5/5-way valve
25 connection
26 retard locking link
27 opening area
28 locking pin
29 first locking pin
30 second locking pin
31 center locking link
32 opening
33 volume flow rate curve
34 flow rate curve
35 crankshaft speed
36 pulse duty factor
37 locking state
38 ignition off
39 engine off
40 current off
41 ignition on
42 unlocking strategy
43 MLP reached
44 ignition
45 locking cover
46 sealing cover
47 spring
48 spring
49 switching valve
50 control unit

What is claimed is:

1. A hydraulic camshaft adjuster for a camshaft comprising:

a stator;

a rotor situated rotatably in the stator during controlled operation, the rotor and the stator forming at least two working chambers situated between the rotor and the stator and separated by a vane fixed to the rotor, the working chambers fillable with hydraulic medium from a hydraulic medium supply device;

an active pressure accumulator;

a first locking link and a second locking link, the first locking link being connected to the active pressure accumulator, the second locking link being separate from and circumferentially offset from the first locking link; and at least one locking pin, the locking pin in a locking state fixing the rotor in a rotatably fixed manner with respect to the stator, the locking pin being movable between the first locking link and the second locking link to lock the rotor at two different rotational positions, the locking pin being connected to the active pressure accumulator in the first locking link, the active pressure accumulator deflecting the locking pin as necessary in the first locking link, the active pressure accumulator configured for being situated below a rotation axis of the rotor, the active pressure accumulator being situated outside of the stator and rotor.

2. The hydraulic camshaft adjuster as recited in claim 1 wherein the active pressure accumulator includes a storage space for the hydraulic medium, the hydraulic medium being transferable from the storage space via a pressure medium line into the interior of the rotor.

3. The hydraulic camshaft adjuster as recited in claim 2 wherein the storage space has a volume $V_1$ greater than a volume $V_{line}$ of the line section from the outlet of the storage space to the working chambers plus the volume $V_{VCP\ chamber}$ of the working chambers.

4. The hydraulic camshaft adjuster as recited in claim 2 wherein an outlet of the storage space is situated below an outlet of the pressure medium line.

5. The hydraulic camshaft adjuster as recited in claim 1 wherein the active pressure accumulator discharges hydraulic medium based on a control signal.

6. The hydraulic camshaft adjuster as recited in claim 1 further comprising a central valve inserted into the rotor, hydraulic medium of the active pressure accumulator suppliable to the working chambers or to the first link, which is designed for accommodating the locking pin via the central valve.

7. The hydraulic camshaft adjuster as recited in claim 1 wherein the at least one locking pin includes two locking pins retractable into the first link, or one of the locking pins is retractably supported in the second link.

8. The hydraulic camshaft adjuster as recited in claim 1 wherein a 5/5-way valve, or a 4/3-way valve and a 3/2-way valve, are inserted between the working chambers and the active pressure accumulator.

9. A method for locking a rotor of a hydraulic camshaft adjuster relative to a stator of the camshaft adjuster, the method comprising:

locking the rotor being with respect to the stator in a center position and also in an advance position or retard position via at least one locking pin, a first locking link and a second locking link, a hydraulic medium of an active pressure accumulator separate from a hydraulic medium supply device provided for filling working chambers between the rotor and the stator and being utilized for influencing a rotary motion of the rotor, the active pressure accumulator being situated outside of the stator and rotor, the first locking link being connected to the active pressure accumulator, the second locking link being separate from and circumferentially offset from the first locking link, the locking pin being movable between the first locking link and the second locking link to lock the rotor in the center position and also in the advance position or retard position, the locking pin being connected to the active pressure accumulator in the first locking link, the active pressure accumulator deflecting the locking pin as necessary in the first locking link.

10. The method as recited in claim 9 wherein the hydraulic medium of the active pressure accumulator is utilized for influencing a longitudinal motion of the locking pin, or the hydraulic medium of the active pressure accumulator is utilized for preventing the locking pin or multiple locking pins from retracting into the first link, the first link being a center locking link.

* * * * *